US006234942B1

(12) United States Patent
Yang

(10) Patent No.: US 6,234,942 B1
(45) Date of Patent: May 22, 2001

(54) COMPOUND EXERCISER UNIT

(75) Inventor: Cheng-hui Yang, 5, Kuo Kuang Street, Taoyuan (TW)

(73) Assignee: Cheng-hui Yang, Taoyuan (TW)

( * ) Notice: Subject to any disclaimer, the term of this patent is extended or adjusted under 35 U.S.C. 154(b) by 0 days.

(21) Appl. No.: 09/392,559

(22) Filed: Sep. 9, 1999

(51) Int. Cl.[7] ..... A63B 21/068

(52) U.S. Cl. ..... 482/132; 482/72; 482/95; 482/96; 482/135; 482/907

(58) Field of Search ..... 482/72, 95, 96, 482/132, 135, 136, 138, 140, 907

(56) References Cited

U.S. PATENT DOCUMENTS

| | | | | |
|---|---|---|---|---|
| 5,429,568 | * | 7/1995 | Chen | 482/96 |
| 5,520,599 | * | 5/1996 | Chen | 482/96 |
| 5,584,784 | * | 12/1996 | Wu | 482/95 |
| 5,722,918 | * | 3/1998 | Lee | 482/72 |
| 6,001,051 | * | 12/1999 | Chran-Pin | 482/131 |

* cited by examiner

*Primary Examiner*—Justine R. Yu
*Assistant Examiner*—Victor Hwang

(74) *Attorney, Agent, or Firm*—Dougherty & Troxell

(57) ABSTRACT

A compound exercise apparatus for extension, stretching and rowing-type exercises where the user's body weight provides a component of the resistive force against which the user exercises. The apparatus includes a base having a pair of stationary foot pedals, a cushion mounted to the top of a support bar for supporting the user's upper body. A lower end of the support bar is mounted to the base and an upper end of the support bar is pivotally mounted to an upper end of a twin-wheeled push rod. The twin-wheeled push rod is biased to a retracted position by an extension spring anchored within the support bar and connected to a cable anchored to a connection post of the twin-wheeled push rod. A fork member having a U-shaped bar at a lower end and a T-shaped connection member at an upper end is pivotally connected to the connection post of the twin-wheeled push rod. A lower end of the U-shaped bar of the fork member is pivotally connected by a linkage to the support bar. The linkage is pivotally connected to a restoration spring that also biases the push rod and support bar to a retracted position. A first end of a handle arm is pivotally mounted to the T-shaped connection member and a second end of the handle arm is releasably connected to the lower end of the U-shaped bar. The handle arm is selectively positioned by the user for the desired exercise. The base is selectively pivotable relative to the support bar so that the apparatus may be folded for storage.

9 Claims, 8 Drawing Sheets

COMPOUND EXERCISER UNIT

BACKGROUND OF THE INVENTION

1. Field of the Invention

The present invention relates to a compound exerciser unit, and more particularly, to one that allows various combinations of exercise by adjusting the extent of opening between a twin-wheel push rod and a support bar, separating a curved bar handle at the lower end of a mobile arm from a telescoping tube in a U-shape bar, and taking advantage of a pivoting status achieved between an axis and a T-shape connection member.

2. Description of the Prior Art

Whereas, a rower generally available in the market relates to railings mounted on a frame with a sliding seat while oars are provided respectively to both sides of the frame so that the user exercises by swinging the oars for a certain extent against the hydraulic resistance applied from a cylinder inside the oar. However, said rower for providing only simulation of rowing a boat against a hydraulic resistance as the user slides himself forward and backward by applying at the same time both pushing and pulling by his both hands and feet, is limited in its use and exercise results, not is not practical.

SUMMARY OF THE INVENTION

The primary purpose of the present invention is to provide a compound exerciser unit by providing an extension spring on an axis inside a linkage pivoted to a U-shape bar of a fork, another end of said extension spring is provided at the bottom of the body of the support bar to facilitate the restoration to normal status of both a twin-wheel push rod and the support bar while pushing forward the fork pivoted to the twin-wheel for extension exercise; furthermore, a curved bar handle provided at the lower end of a mobile arm can be separate from a telescoping tube in the U-shape bar so that the user may do push-ups and rowing at the same time by taking advantage of a pivoting status permitted between a shaft and a T-shape connection member.

Another purpose of the present invention is to provide a structure of a compound exerciser unit in a structure that permits adjustment of resistance by a rotation threaded bolt penetrating the upper section of a connection post, a joint is connected by threads to said rotation bolt, so that when the rotation bolt turns, vertical adjustment can be made. While pushing the mobile arms, the opening tension between the support bar and the twin-wheel push rod can be adjusted depending on the force to be applied at own discretion of the user.

Another purpose yet of the present invention is to provide a compound exerciser unit that allows space-saving when not in use by folding up the mobile pivot at the base to cling to the support bar.

DETAILED DESCRIPTION OF THE INVENTION

Figure 1:
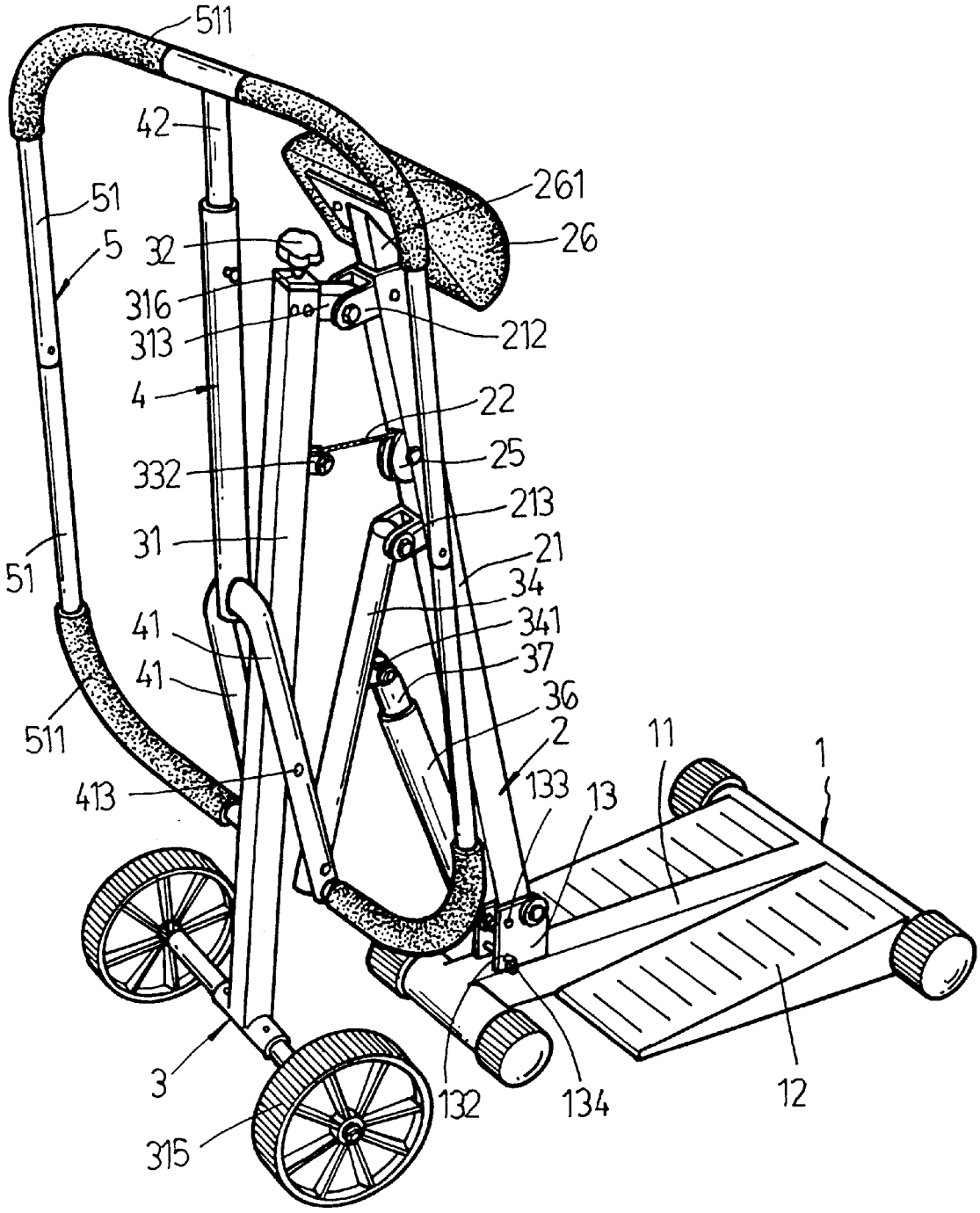
FIG. 1 is a view of the appearance of the present invention.
Figure 2:
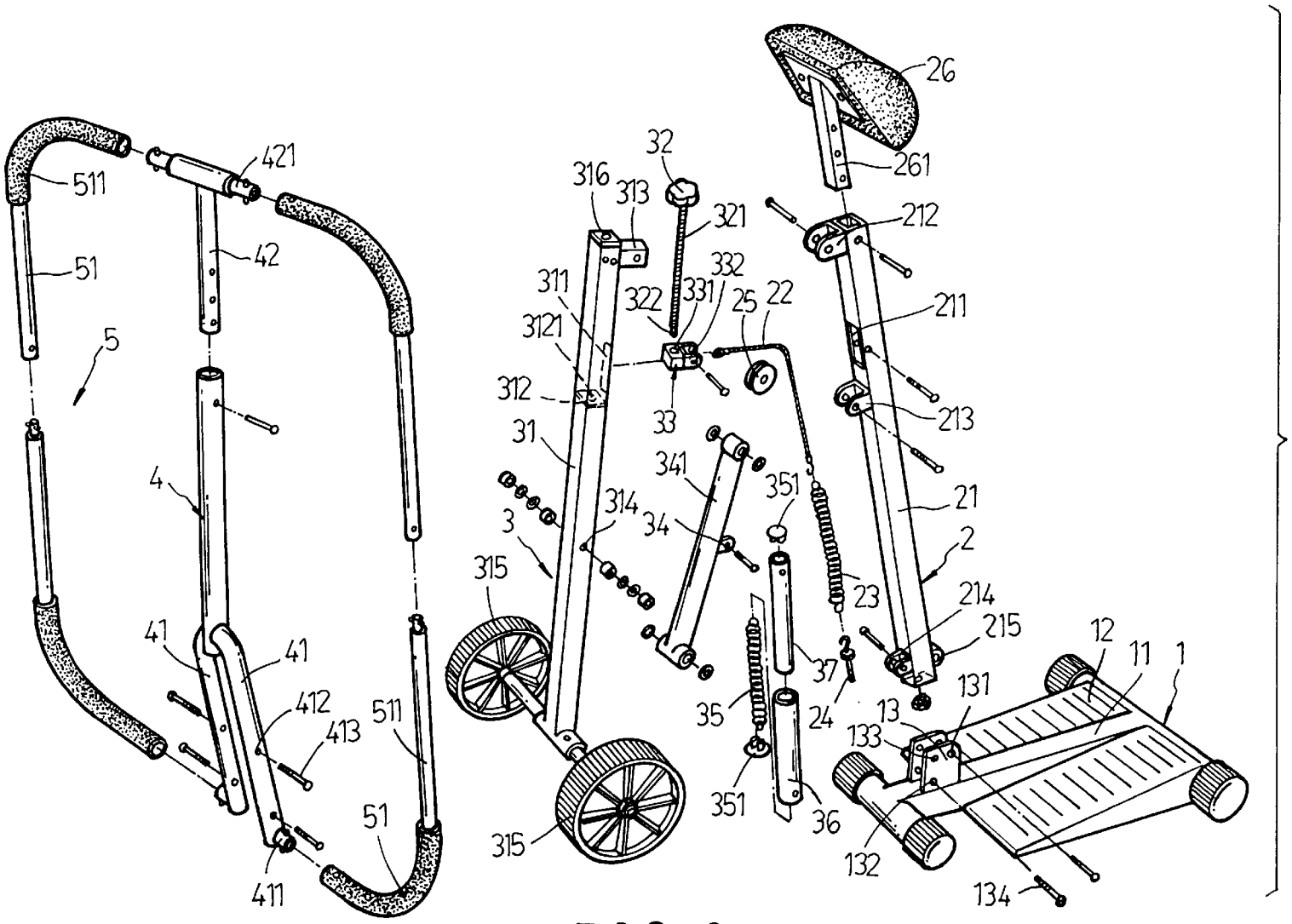
FIG. 2 is an exploded view of the present invention.
Figure 3:
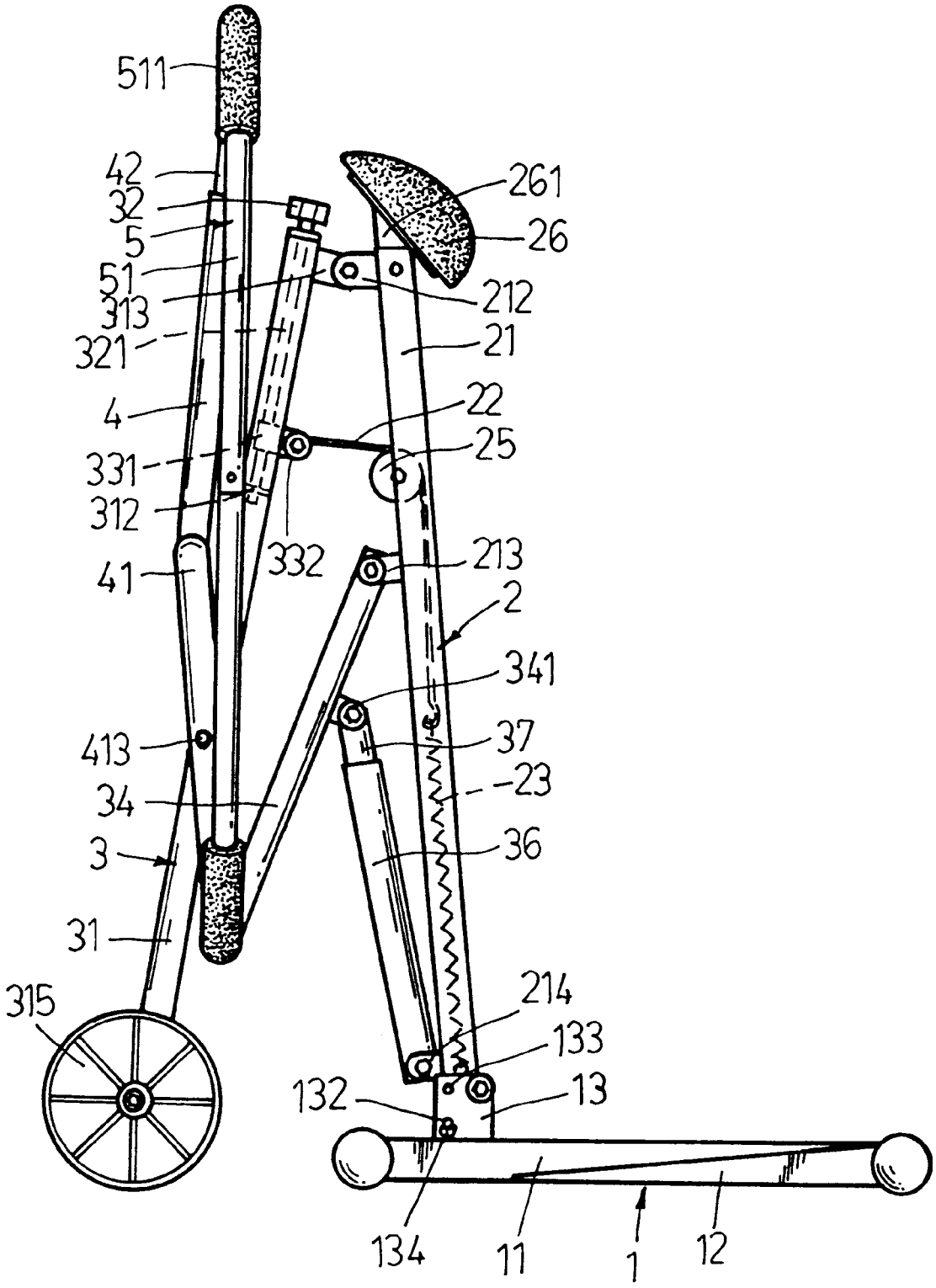
FIG. 3 is a side view of the present invention.

Referring to FIGS. 1, 2 and 3, the present invention is comprised of a base(l), a support bar(2), a twin-wheel push rod(3), a fork(4) and a mobile arm(5). Within, a pair of pedals(12) are respectively fixed to both sides of a main frame(11) of the I-shape base(1), two positioning plates(13) are provided at the front end of said main frame(11) to hold a body(21) of the support bar(2) in position by pivoting a sleeve(215) through an axial hole(131). A cushion(26) slips on the top end of said body(21) and is adjustable for its height by means of a square tube(261) in said body(21). A gap(211) is provided to the upper part inside said body(21), and a bolt with feather(24) is secured at the bottom of said body(21). The top end of said bolt(24) hoops up on one end of an extension spring(23), and another end of said extension spring(23) is connected to a cable(22). Said cable(22) is accommodated in the chute of a pulley(25), and said pulley (25) is pivoted and rotates by means of the body(21) respectively bolted axially to both sides of a gap(211).

Two wheels(315) are provided for the twin-wheel push rod(3) at the bottom of a connection post(31). A short connection bar(313) provided inside the top end of the connection post(31) is capable of connecting to a first saddle joint(212) inside the top end of the body(21) with a pin inserting through said short connection bar. A rectangular opening(311) is provided inside the upper section of said connection post(31) to receive a joint(33). Said joint(33) is screwed with its shank(321) to a screw eye(331) in the joint(33) to hold it in position by means of a rotation bolt(32) provided in a through hole(316) penetrating the top of the connection post(31). A separation plate(312) is provided in the connection post(31) at a distance equal to the length of said shank(321) for a bare post(322) at the bottom of said shank(321) to penetrate a through hole(3121) provided at the center of separation plate; so that when the rotation bolt(32) rotates, the bare post(322) causes friction in the space between it and the through hole(3121) to restrict the rotation bolt(32) in position on the separation plate(312), consequently, to prevent the rotation bolt(32) to separate from the joint(33) while said rotation bolt(32) rotates.

Said joint(33) fixed within the rectangular hole(311) protrudes out of said hole(311) with its U-shape connection end(332), which is fixed to another end of the cable(22)to allow longitudinal movement by the joint(33) while the rotation bolt(32) rotates. When turning said rotation bolt(32) to make the joint(33) moving upward for adjustment, it will be easier for the force so applied to drive the twin-wheel push rod(3). On the contrary, once the joint(33) moves downward for adjustment, an opening angle formed by the support bar(2) and the twin-wheel push rod(3) has been restricted; therefore, greater force is required to push the twin-wheel push rod(3).

A lateral through hole(314) provided below the middle of the connection post(31) allows a U-shape rod(41) of the fork(4)to stride over both sides of the fork(4) while a bolt(413) laterally penetrates through holes(412, 314) to hold the fork(4) in position. A multiple washings and sleeves are used at there the U-shape rod(41) is pivoted to the connection post(31) to reinforce the pivot mechanism. Furthermore, the lower part of the U-shape rod(41) is connected to one end of the linkage(34) while the other end is pivoted onto a second saddle joint(213) of the body(21). A back restoration spring(35) is fixed at where between a saddle joint(341) inside the linkage(34) and a third saddle joint(214) inside the bottom of the body(21); while the base of said back restoration spring(35) is held in position behind an outer sleeve(36) by a fixing member(351), and fixed onto the third saddle joint(214) to provide the restoration force once both of the support bar(2) and the twin-wheel push rod(3) open up. Said outer sleeve(36) and an inner tube(37) are used to retain the stability of the back restoration spring(35) to prevent distortion and from hurting the user.

The top of the fork(4) accommodates a T-shape connection member(42) permitting height adjustment. A shaft(421) is provided with a lateral rod to said T-shape connection member(42), and a pair of curved bar handles(51) each with the mobile arm(5) is respectively slips on and fixed at both sides of said shaft(421). Another pair of curved bar handles (51) also respectively slips on and fixed at A telescoping tube(411) protruding outside the bottom of the U-shape rod(41). Said handles are each protected by a sheathing(511) and both pairs of the curved bar handles(51) are connected to form a frame.

Figure 4:
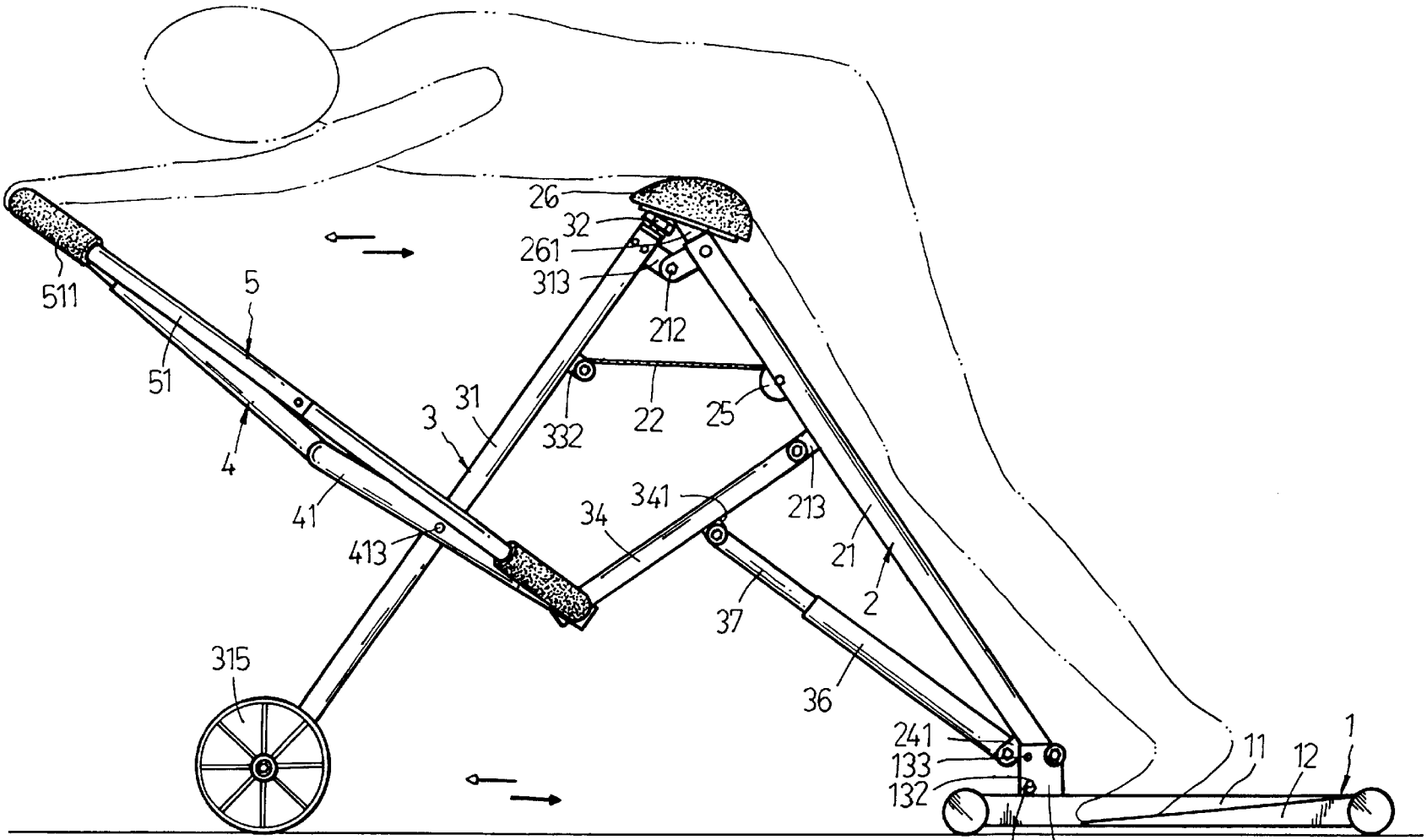
FIG. 4 is a schematic view showing the extension motion achieved by pushing forward a pulley of the present invention.

Now referring to FIG. 4, when the user stands up with both feet respectively on those two pedals(12), his/her abdomen holds against the adjustment cushion(26) with body leaning forward and both hands gripping the pair of handles(51) to both sides of the fork(4). The user then moves forward having the short connection bar (313) and the first saddle joint(212) as the opening support for the support bar(2) and the twin-wheel push rod(3) while making both wheels(315) to turn forward. In the mean time, a vertically compound triangle is formed between the support bar(2) and the twin-wheel push rod(3) as well as among the support bar(2), the fork(4) and the mobile arm(5). Whereas the back restoration spring(35) is provided between the support bar (2) and the twin-wheel push rod(3) by means of the linkage (34), the support bar(2) returns due to the back restoration spring(35) when the user is pushing forward to do extension exercise.

Figure 5:
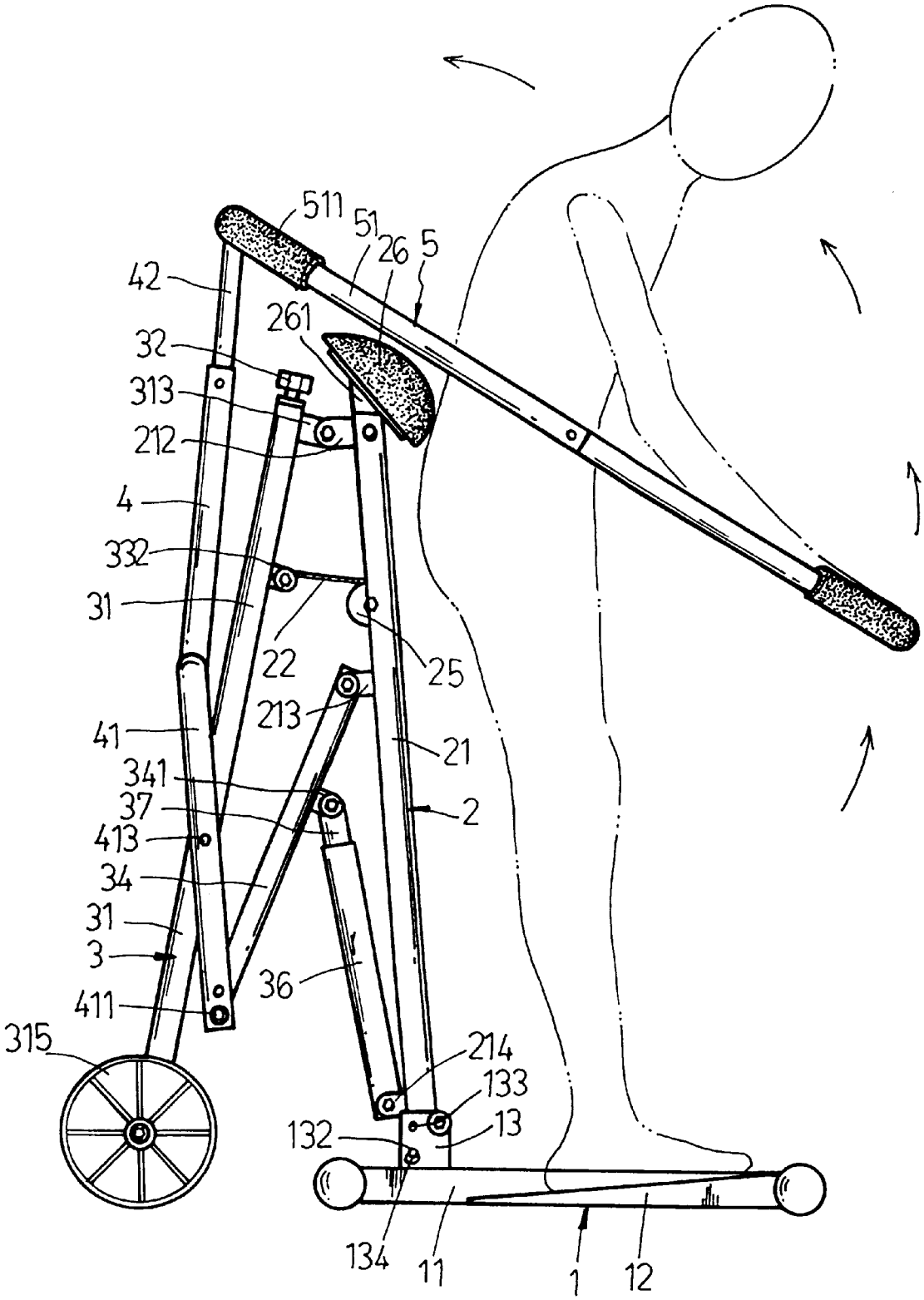
FIG. 5 is a first schematic view showing a push-up rowing motion of the present invention.
Figure 6:
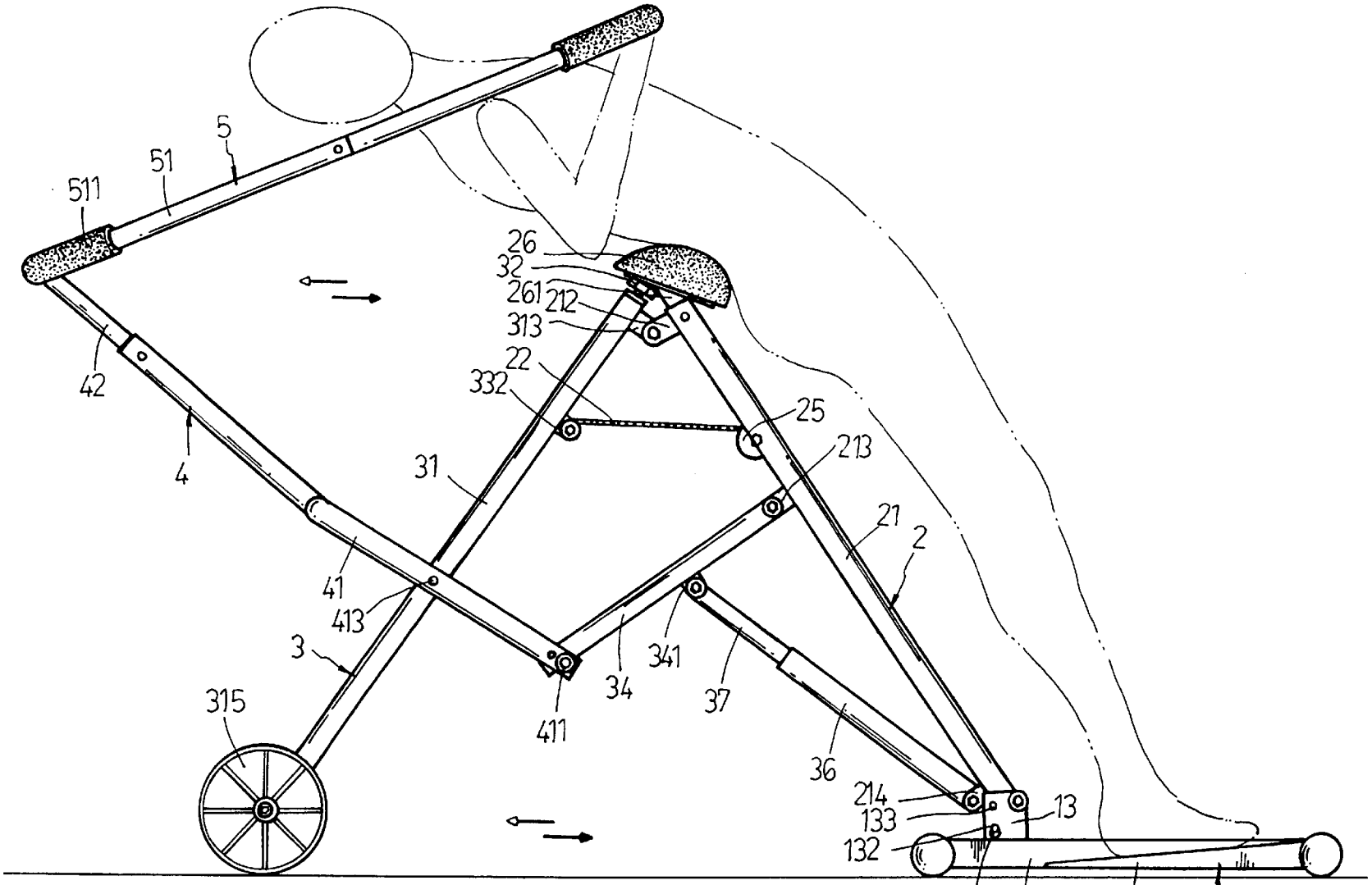
FIG. 6 is a second schematic view showing a push-up rowing motion of the present invention.

As illustrated in FIGS. 5 and 6, the handle(51) at the lower end of the mobile arm(5) can be separated from the telescoping tube(411) of the U-shape rod(41). By utilizing the pivoting status permitted between the shaft(421) and the T-shape connection member(42), the user when working out in standing and lying position rests his/her waist on the adjustable cushion(26) to stretch backward, may grip the sheathing(511) of the curved bar handle(51) then clearing away from the U-shape rod(41); meanwhile, the user may do the rowing exercise after push-up to achieve the work-out results of extension and rowing exercises.

Figure 7:
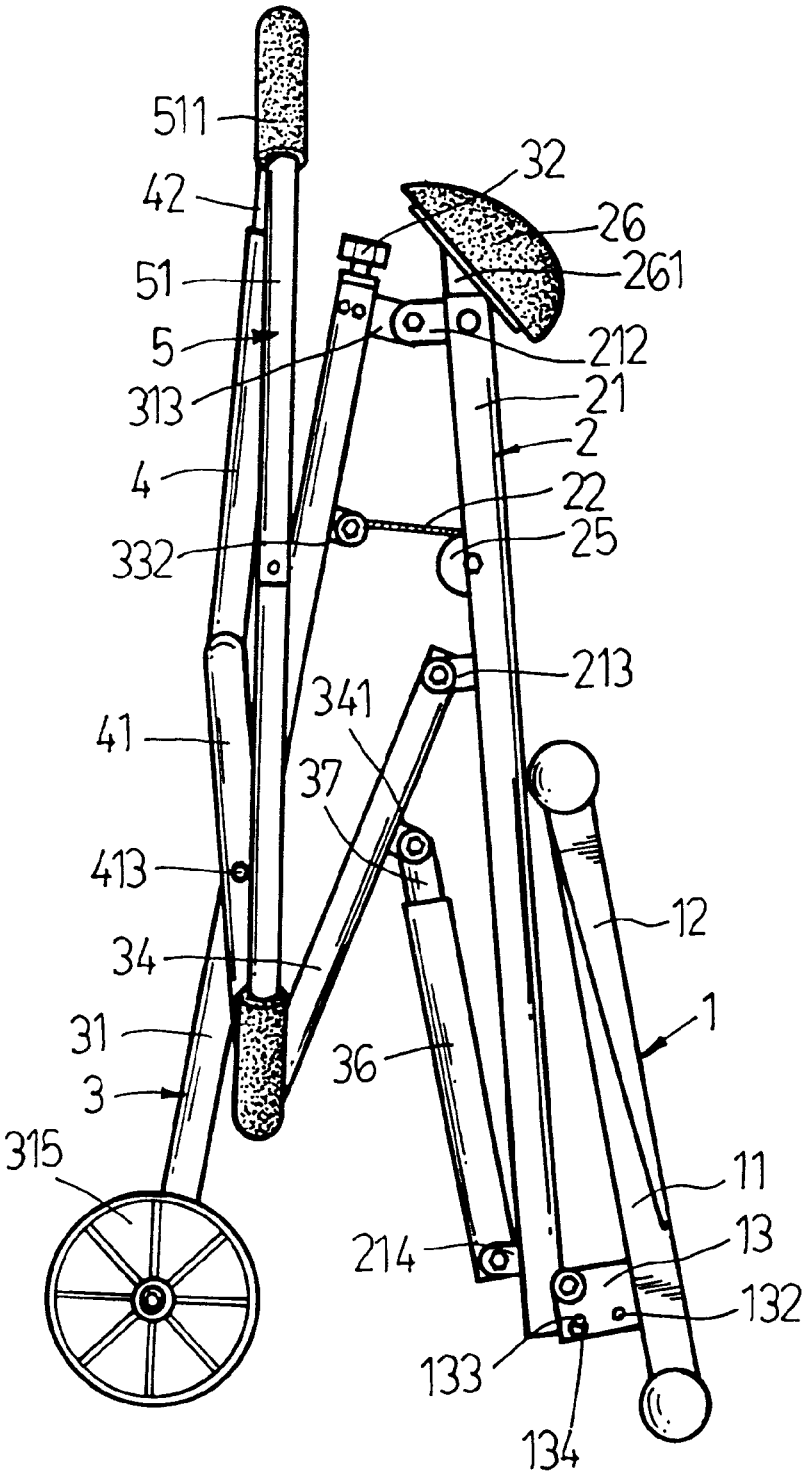
FIG. 7 is a side view of the present invention when stored.
Figure 8:
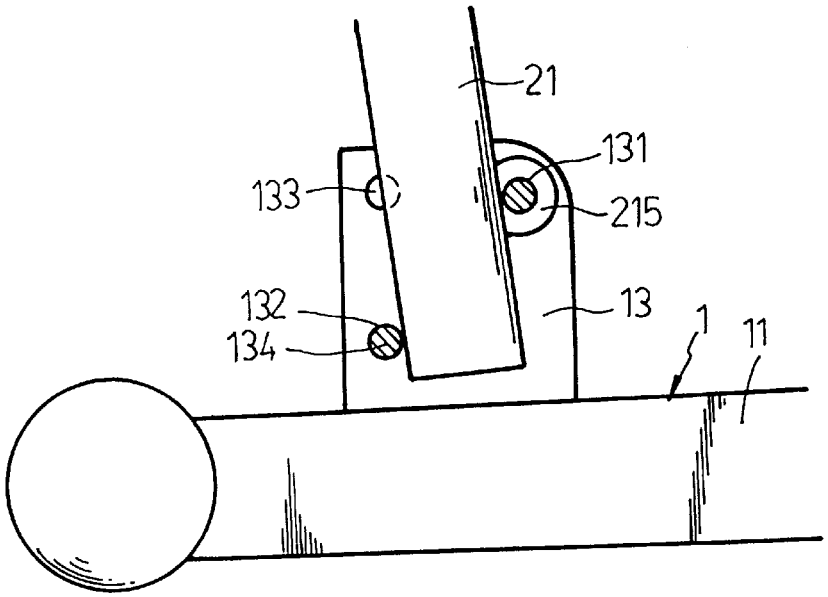
FIG. 8 is a schematic view of a support bar is pivoted to a base of the present invention.
Figure 9:
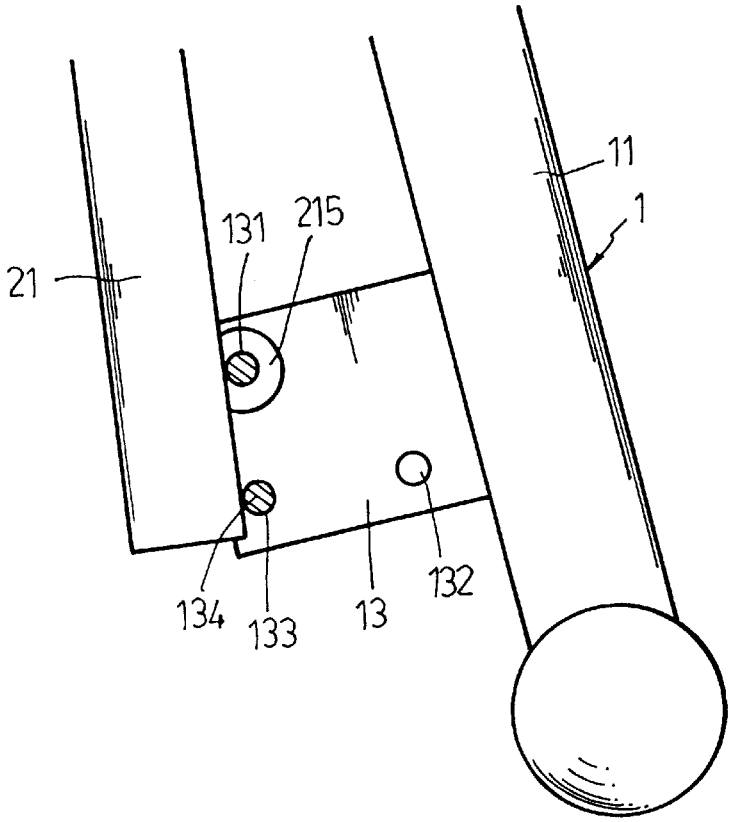
FIG. 9 is a schematic view of the base of the present invention when folded up.

Furthermore, as illustrated in FIGS. 7, 8 and 9, when the present invention is in use, the sleeve(215) to the support bar(2) is pivoted in the axial hole(131) of a positioning plate(13), and provided on a first lateral through hole(132) and a second through hole(133) in the front end of the positioning plate(13). Within, the first lateral through hole (132) is fixed in position with a pin(134) so for the support bar(2) to stand on the base 1. Once said pin(134) is pulled out, the base(1) is able to turn upward and erect with the point at where connected through the axial hole(131), then the same pin(134) is inserted into the second later through hole(133) as its turning support to erect the base(1) resting on the fold-up position on the support bar(2) for space-saving when the present invention is not in use.

Based on the description given above, the present invention sufficiently fulfills the requirements of a utility invention as defined in patent law by disclosing a compound exerciser unit that gives advantages of space-saving when folded up for storage, and providing the user a general stretching work out results by doing the push up and rowing motions at the same time. This application for utility patent is filed accordingly.

What is claimed is:

1. A compound exercise apparatus for performing multiple exercises comprising:

a base with a main frame having a pair of pedals;

a support bar connected to a front end of said main frame;

said support bar having an extension spring and a cable connected to a bolt fixed to an inner bottom of said support bar, the cable reeved over a pulley on said support bar;

a cushion mounted to an upper end of said support bar;

a wheeled push rod connected to a saddle joint on the upper end of said support bar;

a fork having a U-shaped bar at a lower end and a T-shaped connection member at an upper end, said T-shaped connection member connected by an adjustment mechanism to said fork;

said wheeled push rod having a connection post which connects said support bar with said fork;

said connection post having a rectangular hole at an upper end thereof for receiving a joint and a through hole at a top end to receive a rotation bolt with a shank connected to said joint;

a restoration spring connected to a bottom end of said support bar, said restoration spring pivotally connected by a pivoting linkage to said U-shaped bar of the fork to facilitate return of said wheeled push rod and said support bar to a normal status after said fork is pivotally pushed forward relative to said wheeled push rod; and a handle connected to a shaft of the T-shaped connection member, said handle also selectively connected to a telescoping tube at a bottom end of said U-shaped bar;

said handle having a curved handle bar at a lower end of a mobile arm which selectively connects to the bottom end of said U-shaped bar, wherein a user may position their back against the cushion to perform a stretching workout and pivotally position the handle to perform a rowing-type exercise.

2. A compound exercise apparatus as claimed in claim 1, further comprising:

a separation plate provided inside said connection post and located at a distance to engage a bare end of said shank of said rotation bolt, said bare end penetrating a through hole in the center of said separation plate, so that said joint is restricted from disengagement with said rotation bolt.

3. A compound exercise apparatus as claimed in claim 1, wherein said joint protrudes through said rectangular hole of said connection post with a U-shape connection, said U-shape connection connected to an end of said cable so that as said joint is adjusted upward or downward along said shank by rotation of said rotation bolt, an opening load between said wheeled push rod and said support bar may be controlled.

4. A compound exercise apparatus as claimed in claim 1, further comprising:

a positioning plate protruding from the front end of said main frame;

said positioning plate having an axial hole, a first lateral through hole and a second lateral through hole, said holes forming a triangular configuration;

said axial hole connected to a sleeve on said support bar;

said first lateral through hole receiving a pin to engage the bottom of said support bar in a first configuration; and said second lateral through hole receiving said pin to engage said support bar with the base pivoted to a storage position.

5. A compound exercise apparatus as claimed in claim 1, wherein said restoration spring is connected to a saddle joint and is retained between an inner tube and an outer sleeve by fixing members on both ends of said restoration spring, so that the outer sleeve and the inner tube serve to maintain the stability of the back restoration spring without distortion.

6. A compound exercise apparatus as claimed in claim 1, wherein said wheeled push rod is a twin-wheeled push rod.

7. A compound exercise apparatus as claimed in claim 1, wherein said pedals are located on sides of said main frame.

8. A compound exercise apparatus as claimed in claim 1, wherein said pulley is fixed within a gap in said support bar.

9. A compound exercise apparatus comprising:

a base having a stationary foot support;

a support bar pivotally mounted to said base;

a cushion mounted to an upper end of said support bar;

a push rod pivotally connected at an upper end thereof with the upper end of said support bar;

said push rod having at least one wheel mounted to a lower end thereof;

an extension spring and cable positioned within said support bar, said extension spring anchored to a lower end of said support bar;

said cable reeved over a pulley mounted to said support bar, passing out of said support bar through an opening in said support bar and connected to a joint member;

said joint member secured within said push rod and adjustably positioned along a longitudinal length of said push rod by engagement with a rotation bolt mounted to said push rod;

a fork pivotally mounted to said push rod;

a handle member pivotally mounted to an upper T-connection member of said fork and releasably connected to a lower end of a U-shaped bar of said fork;

a link member pivotally connecting the lower end of said U-shaped bar and said support bar; and a restoration spring pivotally connected between said link member and the lower end of said support bar, wherein a user exercises by positioning their body against the cushion with their feet on the foot support and pivotally extending the support bar relative to the push rod and then engaging the handle member to retract the support bar relative to the push rod against resistance provided by the user's weight with assistance from the extension spring and restoration spring.

* * * * *